US008555825B2

(12) United States Patent
Lenz et al.

(10) Patent No.: US 8,555,825 B2
(45) Date of Patent: Oct. 15, 2013

(54) COOLING SYSTEM DEFINED IN A CYLINDER BLOCK OF AN INTERNAL COMBUSTION ENGINE

(75) Inventors: Ingo Lenz, Cologne (DE); Urban Morawitz, Cologne (DE); Richard Fritsche, Wermelskirchen (DE); Guenter Bartsch, Gummersbach (DE); Bernd Steiner, Bergisch Gladbach (DE); Jeroen Slotman, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 250 days.

(21) Appl. No.: 12/846,264

(22) Filed: Jul. 29, 2010

(65) Prior Publication Data

US 2011/0023799 A1 Feb. 3, 2011

(30) Foreign Application Priority Data

Jul. 30, 2009 (EP) ..... 09166865

(51) Int. Cl.
*F02F 1/14* (2006.01)

(52) U.S. Cl.
USPC ..... 123/41.79; 123/41.82 R; 123/193.3

(58) Field of Classification Search
USPC ..... 123/41.79, 41.82 R, 41.72, 193.3, 193.5
See application file for complete search history.

(56) References Cited

U.S. PATENT DOCUMENTS

| | | | | |
|---|---|---|---|---|
| 2,960,974 | A * | 11/1960 | Olsen et al. | 123/41.08 |
| 4,561,388 | A * | 12/1985 | Gwinner et al. | 123/41.74 |
| 4,683,844 | A * | 8/1987 | Arai et al. | 123/41.74 |
| 4,974,569 | A * | 12/1990 | Ampferer et al. | 123/193.2 |
| 5,558,048 | A | 9/1996 | Suzuki et al. | |
| 5,868,107 | A * | 2/1999 | Betsch et al. | 123/41.82 R |
| 6,202,603 | B1 * | 3/2001 | Etemad | 123/41.74 |
| 6,776,127 | B2 * | 8/2004 | Osman | 123/41.72 |
| 6,901,891 | B2 * | 6/2005 | Suzuki et al. | 123/41.79 |

(Continued)

FOREIGN PATENT DOCUMENTS

| | | | |
|---|---|---|---|
| DE | 2007610 | A1 | 8/1971 |
| EP | 0628716 | A1 | 12/1994 |
| EP | 1217198 | A2 | 6/2002 |
| FR | 2905423 | A1 | 3/2008 |
| JP | 5141307 | A | 6/1993 |

OTHER PUBLICATIONS

European Patent Office "Mitteilung" Document dated Apr. 18, 2011 regarding S.N. 83169330207115.

(Continued)

*Primary Examiner* — Noah Kamen
*Assistant Examiner* — Grant Moubry
(74) *Attorney, Agent, or Firm* — Julia Voutyras; Brooks Kushman P.C.

(57) ABSTRACT

An internal combustion engine is disclosed that has a cylinder block with multiple cylinders, a bridge between adjacent cylinders, a cooling slot in the bridge, and a water jacket portion in the cylinder block. A cylinder head is coupled to the cylinder block which has a first cooling passage fluidly coupling the cooling slot and the water jacket portion in the cylinder block, a water jacket portion in the cylinder head, and a second cooling passage in the cylinder head fluidly coupling the cooling slot with the water jacket portion in the cylinder head. A cylinder head gasket is arranged between the cylinder head and the cylinder block which has a first orifice in the cylinder head gasket cooperating with the first cooling passage a second orifice in the cylinder head gasket cooperating with the second cooling passage.

18 Claims, 3 Drawing Sheets

(56) References Cited

U.S. PATENT DOCUMENTS

| | | | | |
|---|---|---|---|---|
| 7,237,511 | B2 * | 7/2007 | Aoki et al. | 123/41.08 |
| 7,278,381 | B2 * | 10/2007 | Matsutani et al. | 123/41.74 |
| 8,261,702 | B2 * | 9/2012 | Fedeson et al. | 123/41.82 R |
| 2009/0151661 | A1 * | 6/2009 | Ahn | 123/41.82 R |

OTHER PUBLICATIONS

European Patent Office "Mitteilung" Document dated Apr. 18, 2011 regarding S.N. 10187422.0.

European Search Report dated Apr. 6, 2010, pp. 1-5.

* cited by examiner

COOLING SYSTEM DEFINED IN A CYLINDER BLOCK OF AN INTERNAL COMBUSTION ENGINE

CROSS-REFERENCE TO RELATED APPLICATIONS

This application claims foreign priority benefits under 35 U.S.C. §119(a)-(d) to EP 09166865.7 filed Jul. 30, 2009, which is hereby incorporated by reference in its entirety.

BACKGROUND

1. Technical Field

The disclosure relates to cooling an internal combustion engine.

2. Background Art

A cylinder block for an internal combustion engine is cast from a metal and includes a cooling jacket through which coolant is circulated to maintain acceptable temperatures. An acceptable temperature is one that is lower than the melting temperature of the material. It is desirable to maintain a temperature lower than that so that the structural integrity of the block is maintained. Furthermore, it is desirable to maintain a uniform temperature within the block to avoid differential expansion. Differential expansion can cause a block at ambient temperature that is dimensionally accurate to fall outside of acceptable tolerances. One measure employed to partially overcome the cooling problems is to provide a cooling slot in a bridge located between adjacent cylinders. Typically, there is no cooling jacket provided in the bridge area to retain sufficient strength. However, the distance between the combustion chamber and the nearest water jacket is great making it a difficult region to cool. To partially overcome this difficulty, it is known to provide a cooling slot in the bridge through which coolant flows. Typically, a cooling passage is provided between the water jacket in the block and the cooling slot. Such slots and passages impact the strength in the vicinity in which they are located.

SUMMARY

To overcome at least one problem, a cooling circuit in a cylinder block and a cylinder head of an internal combustion engine includes: a cooling slot arranged in a bridge between two engine cylinders, a water jacket portion in the cylinder block, a first cooling passage in the cylinder head fluidly coupling the cooling slot and the water jacket portion in the cylinder block. In one embodiment, the first coolant passage is a shallow cavity defined in a surface of the cylinder head proximate the cylinder block. A cylinder head gasket is arranged between the cylinder block and the cylinder head. The cylinder head gasket has a first orifice arranged to allow flow between the first cooling passage and the cooling slot and to allow flow between the first cooling passage and the water jacket portion in the cylinder block. A second cooling passage is fluidly coupled to the cooling slot with the second cooling passage being in the cylinder head or alternatively, in the cylinder block. The cylinder head gasket has a second orifice arranged to permit flow between the cooling slot and the second cooling passage. The cooling circuit has a water jacket portion in the cylinder block and a water jacket portion in the cylinder head. The water jacket portion in the cylinder head includes an exhaust portion and an intake portion. The cooling circuit also includes an outlet housing coupled to both the exhaust portion and the intake portion downstream of the exhaust portion and the intake portion. The cooling circuit may further include an inlet to the engine, a first passage into the cylinder block portion and the cylinder head portion, and a block thermostat disposed in the water jacket portion of the cylinder head. In one embodiment, the block thermostat is integrated in the cylinder block. Alternatively, the block thermostat is separate from the cylinder block. The cooling slot is covered by a cylinder head gasket. The slot has a curved bottom having a radius with the radius less than its thickness measured along the longitudinal axis. The cooling slot may be cast in the bridge or machined into the bridge. In one embodiment, the cooling slot in a cross section perpendicular with the longitudinal axis is a segment of a circle with portions of the bridge on either side of the cooling slot. The cooling jacket portion in the cylinder block has a lower portion and an upper portion with the upper portion narrowing in an upward direction such that the bridge widens outwardly toward bolt holes on either side of the bridge.

Advantages according to embodiments of the disclosure include: obviating a passage through the bore and thereby preserving the integrity of the bridge; obviating a machining operation to provide a cooling passage through the bridge; and maintaining structural integrity in the cooling slot by providing a curved bottom to the slot to minimize stress risers in the block.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
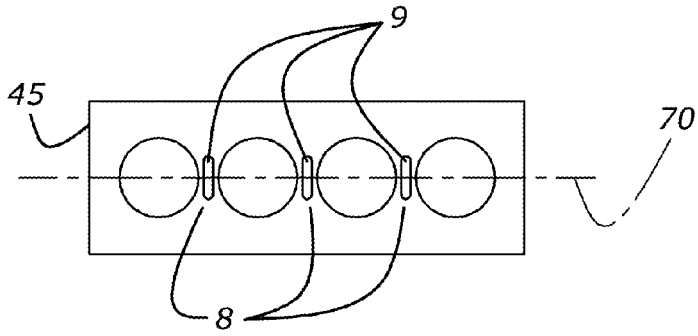
FIG. 1 is a schematic illustration of an engine block.

FIG. 1 shows a schematic of a block 45 of a multi-cylinder, internal-combustion engine with cylinders aligned along a longitudinal axis 70. Between cylinders are bridges 8 having slots 9.

Figure 2:
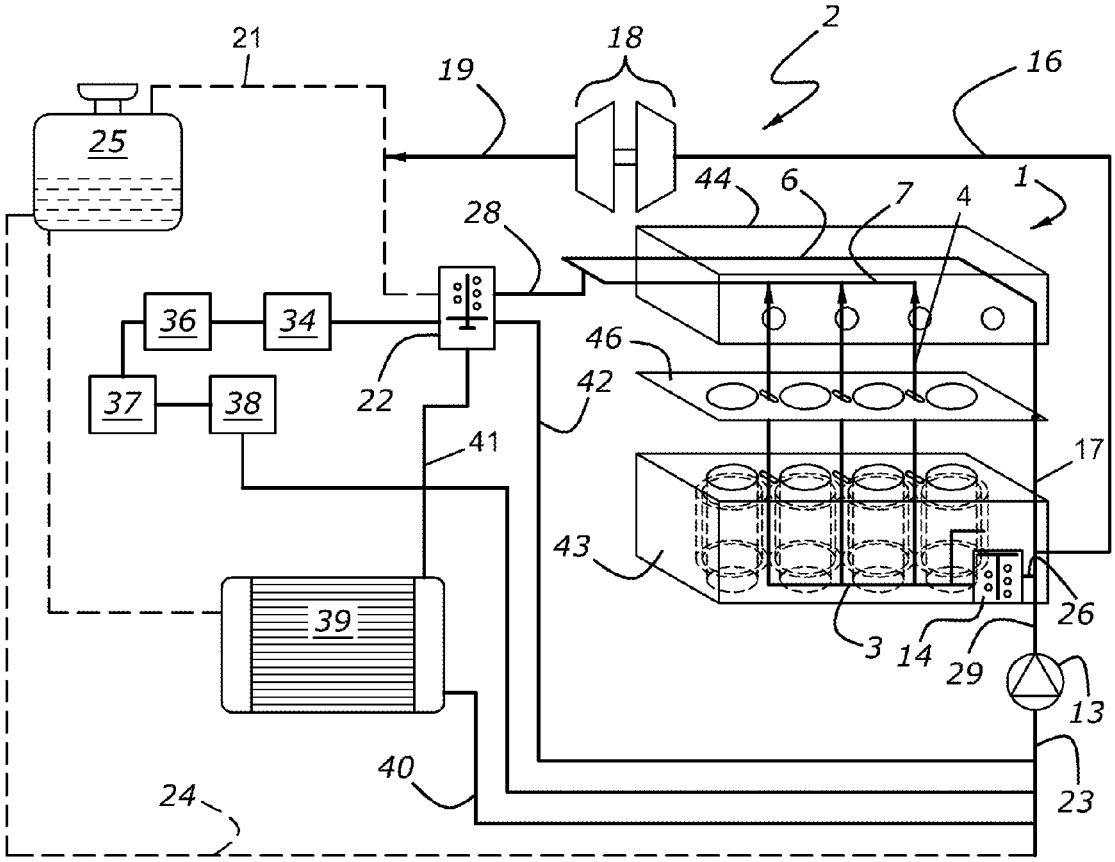
FIG. 2 is a schematic of a cooling circuit of an internal combustion engine according to embodiments of the present disclosure.

FIG. 2 shows an internal combustion engine 1 with a cooling circuit 2. Cooling circuit 2 is divided into a cylinder block water jacket portion 3, and a cylinder head water jacket portion, thereby forming a split cooling system. Further, the cylinder head portion may be divided, for example, into an exhaust portion 6 and an intake portion 7, with exhaust portion 6 proximate exhaust valves and intake portion 7 proximate intake valves. Such arrangement is not intended to limit the disclosure. Coolant flow can be separately controllable in portions 3, 6, and 7. Cooling circuit 2 illustrated by way of example in FIG. 2 is described in more detail below.

Figure 3:
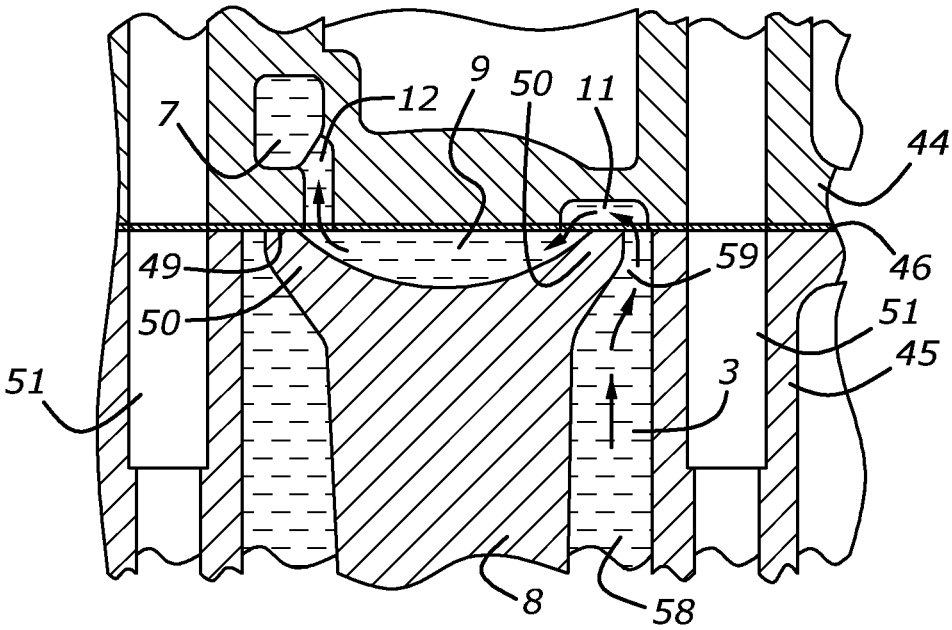
FIG. 3 is a cross section through a bridge of an internal combustion engine according to embodiments of the disclosure.

The view in FIG. 3 is generally perpendicular to the longitudinal axis shown in FIG. 1 and through cooling slot 9. Cooling slot 9 is arranged in at least one bridge 8 of block 45. Cooling slot 9 is fluidly coupled to a cooling passage 11 disposed in a cylinder head 44. Cylinder head 44 is coupled to block 45 by bolts (not shown) with a head gasket 46 between. Cooling passage 11 is also fluidly coupled to a portion of the cylinder block water jacket 3. Cooling passage 11 facilitates flow between the block water jacket (portion 3 in this case) and cooling slot 9 thereby obviating a provision for such fluid communication within the block. In addition to fluidly communicating with cooling passage 11, cooling slot 9 is also fluidly coupled with a cooling passage 12 provided in cylinder head 44. Cooling passage 12 fluidly couples with the cylinder head portion 6 and 7 of cooling circuit 2 and specifically with intake portion 7, in some embodiments. Cooling passage 12 is arranged opposite cooling passage 11 in the cross section shown. Coolant can thus be routed out of the cylinder block water jacket portion 3 via cooling passage 11 into the cooling slot 9, along bridge 8 in the direction of cooling passage 12 into cylinder head portion 6 and 7 of cylinder head 2, possibly intake portion 7 of cylinder head portion.

Referring again to FIG. 2 cooling circuit 2 has a coolant pump 13 providing flow into a coolant pump outlet 29. A block thermostat 14 is integrated into cylinder block 43, per the embodiment of FIG. 2. Alternatively, block thermostat 14 is provided separately. From pump 13, coolant flows into a first branch 17 coupled to cylinder head water jacket portion 6 and 7, a second branch 26 supplying flow to block thermostat 14, and a third branch 16 coupled to a turbocharger 18. In one embodiment, block thermostat 14 contains a wax element that allows coolant flow in one direction only to prevent backflow of coolant in the direction of coolant pump 13. Such flow in the one direction is provided regardless of whether block thermostat 14 is open or closed.

Turbocharger 18, which is supplied by first branch 16, has an outlet passage 19 that flows into a connecting line 21, which then flows into an expansion tank 25. Connecting line 21 couples a cylinder head outlet thermostat 22 and the expansion tank 25. Outlet passage 19 of turbocharger 18 may alternatively be connected directly to a pump inlet 23 or to a coolant pump return 24.

Block thermostat 14 is provided to facilitate the split cooling system. Coolant passing through block thermostat 14, as provided by second branch 26, flows through the water jacket portion 3 of cylinder block 43 and flows directly into intake portion 7 of water jacket portion 6 and 7 of cylinder head 44 without previously having contact with the coolant flowing in exhaust portion 6 of water jacket portion 4. Flow through exhaust portion 6 and intake portion 7 of the water jacket portion enter outlet housing 28. The two coolant streams mix in outlet housing 28 upstream of thermostat 22. A return flow of coolant may then take place, for example, via a venting valve 34, an EGR cooler 36, cabin heater 37, an oil heat exchanger 38. Alternatively, coolant returns through radiator 39 back to coolant pump 13. The arrangement illustrated in FIG. 2 is simply one example embodiment. Alternative arrangements are within the scope of the present disclosure.

As illustrated, thermostat 22 is also connected to radiator 39 which is connected via connecting line 41 to coolant pump inflow 23. It is also possible to connect thermostat 22 to coolant pump inflow 23 via a bypass 42. As illustrated, the oil heat exchanger 38 also issues in the coolant pump inflow 23. Radiator 39 is coupled to expansion tank 25. Thermostat 22 may electrically-activated or may be a conventional mechanical thermostat.

As illustrated, block thermostat 14 is integrated in the cylinder block. However, block thermostat 14 may also be a separate component. In one embodiment coolant pump outlet is connected directly to the cylinder block or to the water jacket portion 3. According to one embodiment, outlet housing 28 is a separate component. In some embodiments, outlet housing 28 may include an EGR valve with corresponding lines to supply the EGR cooler.

In a warm-up phase of the internal combustion engine 1, block thermostat 14 can remain closed for longer, since the vapor or air bubbles which possibly form can be diverted out of the cylinder block or its upper portion via the above-described path comprising cooling passage 11, cooling slot 9, and cooling passage 12 into water jacket portion 6 and 7 or directly into intake portion 7 of the water jacket portion. Consequently, warm-up behavior of the internal combustion engine is decisively improved, since block thermostat 14 is opened only when an exchange of the coolant in the water jacket 3 in the cylinder block 43 is beneficial.

Cooling slot 9 is not connected to water jacket portion 3 directly. Instead, it is indirectly connected via cooling passage 11. Cooling passage 11 is, in one embodiment, an elongated void defined in a face of cylinder head 44.

Figure 4:
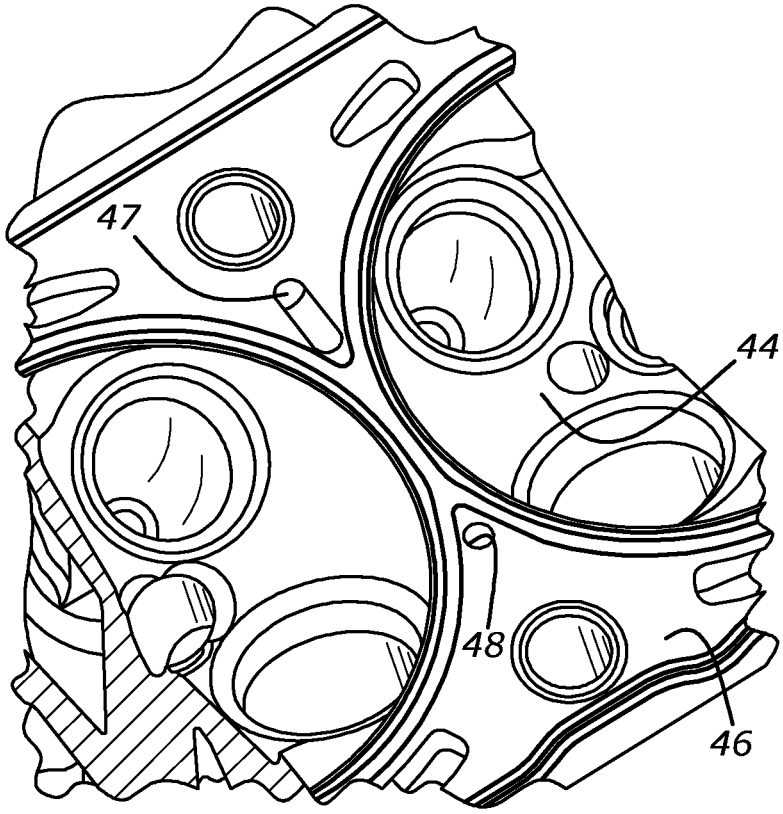
FIG. 4 is a head gasket according to an embodiment of the disclosure.

In FIG. 3, between cylinder head 44 and cylinder block 45 is a cylinder head gasket 46 provided to seal between head 44 and block 45. However, flow between head 44 and block 45 is desired in certain places. In particular, gasket 46, as illustrated in FIG. 4, has an elongated orifice 47 to facilitate flow between water jacket portion 3 and cooling passage 11 and between cooling passage 11 and cooling slot 9. Orifice 47 may be of other shapes in other embodiments, but is designed to cooperate with cooling passage 11. An orifice 48 is provided to allow flow between cooling slot 9 and cooling passage 12.

Because no direct connection between cooling slot 9 and water jacket portion 3 is provided, an upper portion 49 of bridge 8 is not disturbed, i.e., upper portion 49 is cast and not damaged by providing a direct passageway through upper portion 49 to provide flow between cooling slot 9 and water jacket portion 3.

In FIG. 3, cooling jacket portion 3 has a lower portion 58 and an upper portion 59. Upper portion 59 necks down in cross section in a direction toward cylinder head 44. Bridge 8, consequently, increases in width when moving in a direction toward cylinder head 44 having balconies 50 near the top of the block.

Cooling slot 9 may be cast in when cylinder block 45 is produced. Alternatively, cooling slot is machined into cylinder block 45 after casting. In one embodiment, a side milling cutter is used in which case cooling slot 9 is created by plunging side milling cutter vertically into bridge 8. It is possible to reduce the radius of the side milling cutter and, after the latter has been moved in vertically, to carry out a horizontal traveling movement along the planned cooling slot 9. According to yet another alternative, a suitable pin-type milling cutter may be used.

In FIG. 2, cooling slot 9 is segment of a circle, as seen in cross section. Cooling slot 9 is provided to improve cooling in the vicinity of bridge 8.

Bolt holes 51 are provided in cylinder head 44 and in cylinder block 45. In one alternative water jacket portions are provided that contact bolt holes 51.

Figure 5:
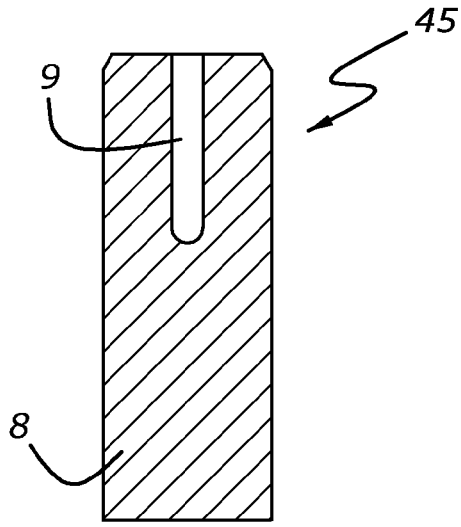
FIG. 5 is a longitudinal section through the cylinder block and cooling slot (perpendicular section to that shown in FIG. 3)
Figure 6:
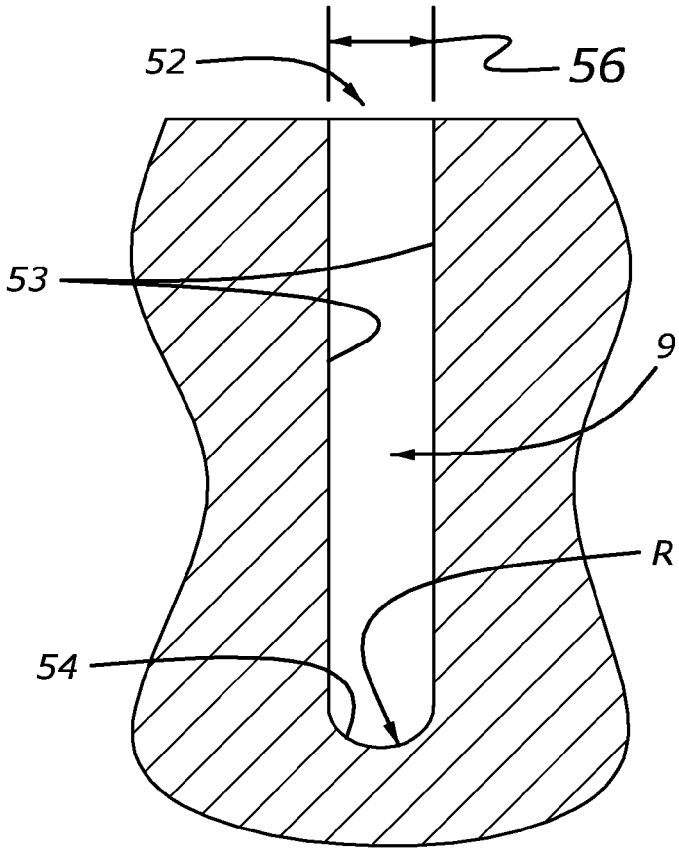
FIG. 6 is a detail of the cooling slot from FIG. 5.

FIG. 6 shows the cooling slot 9 from FIG. 5 in detail in a longitudinal section. Cooling slot 9 has a slot orifice 52 with slot walls 53 and a slot bottom 54. Slot orifice 52 is covered by cylinder head gasket 46. Slot walls 53 are spaced apart from one another by the amount of the slot width 56 and merge into the slot bottom 54. In one embodiment, slot bottom 54 is designed to be rounded with a radius, the amount of which is smaller than the slot width 56. Cooling slot 9 is formed by a slotting tool which has a "tip" with a correspondingly pronounced rounding.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. A cooling circuit defined in a cylinder block and a cylinder head of an internal combustion engine, comprising:
- a cooling slot arranged on a top surface of the cylinder block in a bridge between two engine cylinders;
- a water jacket portion in the cylinder block; and
- a first cooling passage in the cylinder head cooperating with a cylinder head gasket fluidly coupling the cooling slot and the water jacket portion in the cylinder block; and
- a second cooling passage defined in the cylinder head and fluidly coupled to the cooling slot.

2. The cooling circuit of claim 1 wherein the first cooling passage is a shallow cavity defined in a surface of the cylinder head proximate the cylinder block.

3. The cooling circuit of claim 1, wherein the cylinder head gasket is arranged between the cylinder block and the cylinder head, the cylinder head gasket having a first orifice arranged to allow flow between the first cooling passage and the cooling slot and to allow flow between the first cooling passage and the water jacket portion in the cylinder block and a second orifice arranged to permit flow between the cooling slot and the second cooling passage.

4. The cooling circuit of claim 1 wherein the cooling circuit has the water jacket portion in the cylinder block and a water jacket portion in the cylinder head; the water jacket portion in the cylinder head includes an exhaust portion and an intake portion, the cooling circuit further comprising:
- an outlet housing coupled to both the exhaust portion and the intake portion downstream of the exhaust portion and the intake portion.

5. The cooling circuit of claim 4, further comprising:
- an inlet to the engine;
- a first passage into the water jacket portion and the cylinder head portion; and
- a block thermostat disposed in the water jacket portion in the cylinder block.

6. The cooling circuit of claim 5 wherein the block thermostat is integrated in the cylinder block.

7. The cooling circuit of claim 6 wherein the block thermostat is separate from the cylinder block.

8. The cooling circuit of claim 1 wherein the cooling slot is covered by a cylinder head gasket, the slot has a thickness, the slot has a curved bottom having a radius with the radius less than the thickness.

9. The cooling circuit of claim 1 wherein the cooling slot is one of: cast in the bridge of the cylinder block and machined into the bridge of the cylinder block.

10. A cylinder block, comprising:
- two cylinders arranged along a longitudinal axis;
- a bridge between the two cylinders; and
- a cooling slot arranged in the surface of the bridge and cooperating with a head gasket and the bridge to direct coolant flow from the cylinder block through a cylinder head and into the cooling slot.

11. The cylinder block of claim 10 wherein the cooling slot in a cross section perpendicular with the longitudinal axis is a segment of a circle with portions of the bridge on either side of the cooling slot.

12. The cylinder block of claim 10 wherein the cooling slot is cast in the cylinder block.

13. The cylinder block of claim 10 wherein the cooling slot is machined into the cylinder block.

14. The cylinder block of claim 10, further comprising:
- bolt holes on either side of the bridge; and
- a cooling jacket portion on one side of the bridge having a lower portion and an upper portion wherein the upper portion narrows in an upward direction such that the bridge widens outwardly toward the bolt holes.

15. An internal combustion engine having a cylinder block, comprising:
- multiple cylinders;
- a bridge between adjacent cylinders;
- a cooling slot arranged on a top surface of the cylinder block in the bridge; and
- a water jacket portion in the cylinder block cooperating with a cylinder head gasket allowing indirect flow between the water jacket portion and the cooling slot.

16. The engine of claim 15, further comprising:
- a cylinder head coupled to the cylinder block; and
- a first cooling passage in the cylinder head fluidly coupling the cooling slot and the water jacket portion in the cylinder block.

17. The engine of claim 16, further comprising:
- a cylinder head gasket arranged between the cylinder head and the cylinder block; and
- a first orifice in the cylinder head gasket cooperating with the first cooling passage.

18. The engine of claim 17, further comprising:
- a water jacket portion in the cylinder head;
- a second cooling passage in the cylinder head fluidly coupling the cooling slot with the water jacket portion in the cylinder head; and a second orifice in the cylinder head gasket cooperating with the second cooling passage.

* * * * *